US006765495B1

(12) United States Patent
Dunning et al.

(10) Patent No.: US 6,765,495 B1
(45) Date of Patent: Jul. 20, 2004

(54) INTER VEHICLE COMMUNICATION SYSTEM

(75) Inventors: Gilmore J. Dunning, Newbury Park, CA (US); Tsung-Yuan Hsu, Westlake Village, CA (US); David M. Pepper, Malibu, CA (US); Anson Au, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/589,637

(22) Filed: Jun. 7, 2000

(51) Int. Cl.[7] ..... G08G 1/16

(52) U.S. Cl. ..... 340/903; 340/435; 340/439; 340/902

(58) Field of Search ..... 340/901, 902, 340/903, 904, 942, 439, 435, 436; 359/109, 169, 174

(56) References Cited

U.S. PATENT DOCUMENTS

| | | | | |
|---|---|---|---|---|
| 3,914,692 A | * | 10/1975 | Sceaborn, Jr. | 325/53 |
| 3,940,630 A | * | 2/1976 | Bergonz | 250/568 |
| 3,969,621 A | * | 7/1976 | Ferrell | 240/41.35 |
| 4,271,507 A | * | 6/1981 | Gable et al. | 370/94 |
| 4,706,086 A | | 11/1987 | Panizza | 340/902 |
| 5,015,918 A | * | 5/1991 | Copeland | 315/76 |
| 5,101,198 A | | 3/1992 | Abou et al. | 340/825.5 |

(List continued on next page.)

FOREIGN PATENT DOCUMENTS

| | | |
|---|---|---|
| DE | 25 59 184 A1 | 7/1977 |
| DE | 40 34 681 A1 | 5/1992 |

(List continued on next page.)

OTHER PUBLICATIONS

Fujii, H., et al., "Experimental Research on Inter–Vehicle Communication using Infrared Rays," *IEEE Intelligent Vehicles Symposium,* pp. 266–271 (1996).

*Primary Examiner*—Benjamin C. Lee
*Assistant Examiner*—Phung Nguyen
(74) *Attorney, Agent, or Firm*—Ladas & Parry

(57) ABSTRACT

An inter vehicle communication system wherein information transfer between vehicles is provided by data sources, data sensors, and vehicle sensors on each vehicle connected to a central processing unit on each vehicle. The central processing unit receives information from other vehicles via the data sensors and calculates information weights for that data. Information weights may be based upon temporal or spatial displacement, or other factors. The central processing unit then combines that weighted data with data provided by onboard vehicle sensors to determine vehicle and situational status. The central processing unit will then provide control information to the vehicle or vehicle operator. The central processing unit also creates messages for transfer to other vehicles via the data sources contained in the vehicle. Preferably, the data sources are provided by adapting vehicle headlights, taillights, or other existing lights sources for optical data transfer. Data sensors would then be provided by optical data sensors.

61 Claims, 3 Drawing Sheets

U.S. PATENT DOCUMENTS

| | | | | | |
|---|---|---|---|---|---|
| 5,126,735 | A | * | 6/1992 | Trevijano | 340/902 |
| 5,202,913 | A | | 4/1993 | Lang et al. | 379/58 |
| 5,204,536 | A | * | 4/1993 | Vardi | 250/551 |
| 5,249,027 | A | | 9/1993 | Mathur et al. | 356/1 |
| 5,357,438 | A | * | 10/1994 | Davidian | 364/461 |
| 5,424,726 | A | | 6/1995 | Beymer | 340/902 |
| 5,477,232 | A | | 12/1995 | Yamamoto | 343/713 |
| 5,502,301 | A | | 3/1996 | Lord | 250/227.14 |
| 5,568,136 | A | | 10/1996 | Hochstein et al. | 340/903 |
| 5,589,827 | A | | 12/1996 | Scurati | 340/901 |
| 5,666,028 | A | | 9/1997 | Bechtel et al. | 315/82 |
| 5,680,122 | A | | 10/1997 | Mio | 340/932 |
| 5,711,590 | A | | 1/1998 | Gotoh et al. | 362/43 |
| 5,713,654 | A | | 2/1998 | Scifres | 362/80 |
| 5,745,027 | A | | 4/1998 | Malville | 340/310.01 |
| 5,758,313 | A | | 5/1998 | Shah et al. | 701/208 |
| 5,760,708 | A | * | 6/1998 | Seith | 340/903 |
| 5,825,763 | A | | 10/1998 | Kato et al. | 370/335 |
| 5,847,661 | A | * | 12/1998 | Ricci | 340/902 |
| 6,021,308 | A | * | 2/2000 | Kimura | 455/6.3 |
| 6,085,151 | A | * | 7/2000 | Farmer et al. | 701/301 |
| 6,121,896 | A | | 9/2000 | Rahman | 340/902 |
| 6,150,931 | A | * | 11/2000 | Yamagata et al. | 340/435 |
| 6,150,961 | A | | 11/2000 | Alewine et al. | 340/995 |
| 6,152,588 | A | * | 11/2000 | Scifres | 362/496 |
| 6,275,145 | B1 | * | 8/2001 | Rogozinski | 340/425.5 |
| 6,278,360 | B1 | * | 8/2001 | Yanagi | 340/436 |
| 6,400,482 | B1 | * | 6/2002 | Lupton et al. | 359/154 |
| 6,498,570 | B2 | * | 12/2002 | Ross | 340/901 |

FOREIGN PATENT DOCUMENTS

| | | | |
|---|---|---|---|
| DE | 197 40 602 | A1 | 3/1999 |
| DE | 199 48 733 | A1 | 4/2001 |
| EP | 0 627 719 | A2 | 12/1994 |
| EP | 0 897 168 | A2 | 2/1999 |
| EP | 0 927 983 | A2 | 7/1999 |
| EP | 0 962 907 | A2 | 8/1999 |
| EP | 0 959 442 | A2 | 11/1999 |
| GB | 2 349 000 | A | 10/2000 |
| WO | WO 91/16699 | | 10/1991 |

* cited by examiner

INTER VEHICLE COMMUNICATION SYSTEM

FIELD OF THE INVENTION

The present invention relates to a low-cost communication system for vehicles to permit the exchange of data between vehicles as they travel along a highway.

BACKGROUND OF THE INVENTION

When driving a vehicle, such as an automobile or truck on a highway, the observation of driving conditions tends to be up to each individual driver. Of course, drivers can receive safety information from public radio stations or even from other drivers through two-way radios such as citizens band radios available in the United States. However, both the safety of the situations in which drivers find themselves and the degree satisfaction or dissatisfaction which driving gives them is directly dependent upon the ability of the driver to collect and interpret necessary data, including listening to reports on the radio, and then be able to take the appropriate action within a required response time. Unfortunately, since the human driver does not always collect and interpret necessary data appropriately, many traffic accidents occur on the highways today because of human error, or near misses occur which tends to give the driver an intense sense of dissatisfaction with the driving experience.

Prior art systems have attempted to provide mechanisms for transferring data between automobiles traveling on highways. U.S. Pat. No. 4,706,086 issued to E. Panizza on Nov. 10, 1987 discloses a system for signaling between vehicles. In Panizza, sensors are used to detect various vehicle parameters. A processing unit processes the sensor data to determine the vehicle environment and to create a signal message about the environment. This message is then sent to one or more vehicles traveling in the opposite direction via infrared or directional radio frequency transmission. These vehicles, if equipped with the signaling system, will process and retransmit the message to vehicles traveling in the same direction as the first vehicle. Hence, this system relies upon the presence of vehicles traveling in the opposite direction to pass messages to trailing vehicles and also relies upon a clear transmission path between vehicles in opposite lanes of the highway. Many U.S. highways are constructed such that opposing lanes are obstructed from each other, so the signaling system disclosed by Panizza may not work on such highways.

Another signaling system is disclosed in U.S. Pat. No. 5,589,827 issued to M. Scurati on Dec. 31, 1996. Scurati discloses a system where vehicle information such as speed, acceleration, location, etc. is passed from a lead vehicle to a following vehicle in a chain of vehicles by radio frequency transmission. The system relies upon tight synchronization of transmissions so that the transmission between the vehicles will not interfere with one another. This synchronization is optimally obtained from master stations providing synchronization data to all vehicles within a stretch of highway. Degraded synchronization results when the transmit and receive systems in each vehicle self-synchronize, with the possibility that some transmissions may interfere with each other. The system disclosed by Scurati transfers information from leading vehicles to following vehicles, and does not provide the capability to transfer information from following vehicles to leading vehicles or to vehicles traveling in the opposite direction.

Still another signaling system is disclosed in U.S. Pat. No. 5,424,726 issued to B. Beymer on Jun. 13, 1995. Beymer discloses a system that generally transmits vehicle information rearward by a radio frequency transmitter mounted on the rear of a lead vehicle received by a receiver mounted on the front of a following vehicle. Beymer also allows for the transmission of information forward from a following vehicle to a lead vehicle by using a forward-mounted radio frequency transmitter and a rear-mounted receiver. However, the system disclosed by Beymer relies upon highly directional transmitters to ensure that only vehicles in a substantially linear chain will be in communication. Thus, vehicles in adjacent or opposing lanes will not receive vehicle information.

Prior art systems are characterized by the use of additional components to achieve data communication between vehicles. These additional components lead to higher cost, more maintenance, and less consumer acceptance of vehicles equipped with such systems. System that rely upon radio frequency transmission are subject to interference from other radio frequency sources and possible regulatory concerns. Thus, there exists a need in the art for a low cost, interference-resistant system for communicating between vehicles.

The present invention provides low-cost, communication links between vehicles, such as private, commercial, law enforcement automobiles and trucks or even boats and trains, preferably using existing vehicular optical components combined with low cost sensors. By encoding information onto vehicle components such as headlights and taillights at appropriate data rates (less than 1 KHz for some applications), information can be transmitted between vehicles. The modulated light is sensed and decoded on board the vehicle using detectors and the encoded data need not be directly perceived by the driver. The data stream can provide critical information to the driver, including collision avoidance warnings, information about the presence of am emergency vehicle, etc., in addition to information about neighboring vehicles.

A typical application of the system is to automatically address vehicle spacing. Position and velocity information for a vehicle is obtained from sensors or data sources such as Global Positioning Satellite receivers. The inter vehicle communication system provides this information to surrounding vehicles, which then process the information to determine vehicle spacing. If a forward vehicle determines that it is being followed too closely, the forward vehicle's brake lights might flash rapidly (as if the brakes were pumped) to alert the offender of a possible safety hazard. At the same time, proximity alert information may be sent via the inter vehicle communication system from the forward vehicle to the trailing vehicle to result in an alarm or warning message in the offender's vehicle. This system effectively takes the driver in the forward vehicle out of the loop, by automatically signaling the tailgating vehicle.

Automatic inter vehicle communication provides additional advantages such as reduction in driver stress, safer lane changes, reduced travel time, and improved route planning. The advantages of the present invention are further enhanced by supporting communication among multiple vehicles. Small corner-cubes or retroreflector arrays (on either or both vehicles) can be used to relay information back to other vehicles for range-Doppler or other accident avoidance information (via time-of-flight measurements). The present invention can also be used to propagate emergency vehicle warnings among multiple vehicles. The use of new gas discharge lamps for headlights, as well as LEDs and neon discharge taillights provides an opportunity for very high data rates with minimal modification to existing hardware on vehicles.

SUMMARY OF THE INVENTION

An object of the present invention is to provide an inter vehicle communication system for communicating between vehicles using data sources, data sensors, and vehicle sensors on each vehicle and a central processing unit on each vehicle for processing the data passed between vehicles. The data sensors, preferably optical, will receive data messages from other vehicles with the inter vehicle communication system. The central processing unit will weight this received data according to its time of generation, distance from its source, and other factors. The central processing unit will then process the weighted data along with onboard data sensed from the vehicle by vehicle sensors. The onboard data may include speed, rate of the acceleration/deceleration, steering wheel angle, yaw rate, intended lane change, braking, location, and other vehicle information. The central processing unit will then provide control information to the vehicle. This control information may include specific control commands for vehicle operation, or alerts to the vehicle operator. The central processing unit will also create a data message for transfer to other vehicles. The message will be sent to other vehicles using data sources, again preferably optical.

In operation, the central processing unit on the first vehicle will control the transfer of information to a second vehicle concerning the speed, rate of the acceleration/deceleration, steering wheel angle, yaw rate, intended lane change, braking, location, and other vehicle information about the first vehicle using a source or sources, preferably optical, on the first vehicle. The second vehicle will receive the information via a sensor or sensors, again preferably optical, and the central processing unit on the second vehicle will process the received information, apply weights to the information, alert the vehicle operator or control vehicle operation, and create messages to be sent to other vehicles.

An additional object of the present invention is to provide a method for relaying emergency information among multiple vehicles using inter vehicle communication to transfer the information from one vehicle to the next.

A first embodiment of the present invention provides an inter vehicle communication system for communicating between a plurality of vehicles, in which each vehicle contains an apparatus comprising: a central processing unit; data sources coupled to the central processing unit; data sensors coupled to the central processing unit; and vehicle sensors coupled to the central processing unit, in which the central processing unit processes data received from the data sensors and from the vehicle sensors, calculates information weights for the data, generates a transmit message based on the data, and provides the transmit message to the data sources.

Another embodiment of the present invention provides a method of inter vehicle communication comprising the steps of: sensing vehicle information; creating a transmit vehicle message; transmitting the transmit vehicle message; receiving the transmit vehicle message at a receive vehicle; sensing receive vehicle information; extracting vehicle information from the transmit vehicle message; weighting the vehicle information to create weighted vehicle information; processing the the receive vehicle information and the weighted vehicle information to determine inter vehicle status; and providing control information to a receive vehicle control system based on the inter vehicle status.

Another embodiment of the present invention provides a method of inter vehicle communication between multiple vehicles comprising the steps of: sensing current transmit vehicle information; creating a message for each transmit vehicle; transmitting the message; receiving the message from each transmit vehicle at a receive vehicle; extracting current transmit vehicle information from the message; creating weighted transmit vehicle information from the received vehicle information; reading receive vehicle information from receive vehicle sensors; and processing the weighted transmit vehicle information and receive vehicle information to determine multiple vehicle status.

Another embodiment of the present invention provides an inter vehicle communication system comprising: one or more light sources on a first vehicle, such that the light sources radiate light in a spectrum visible to the human eye; means for modulating the light radiated from the light sources with data; one or more light sensors on a second vehicle, such that the light sensors detect the modulated light from the first vehicle; and means for demodulating the detected light signal to extract the data. The light sources may include headlights, taillights, side lights, emergency beacons, or other visible light sources. Use of such light sources allows the lights sources to have a dual use. The first and primary use is for visual illumination or warning, while the second use is the provision of a mechanism for inter vehicle communication. The means for modulating the light includes electrical modulators that change the voltage or current applied to the light source based upon the data, liquid crystal light valves that cover the light source and transmit light based upon the data, or liquid crystal light valves that cover reflective elements such that light directed onto the elements with be reflected based upon the data. Lights sensors such as photo detectors can be used, and the means for demodulating the detected signal may comprise demodulator circuits well known in the art.

DETAILED DESCRIPTION OF PREFERRED EMBODIMENTS

Figure 1:
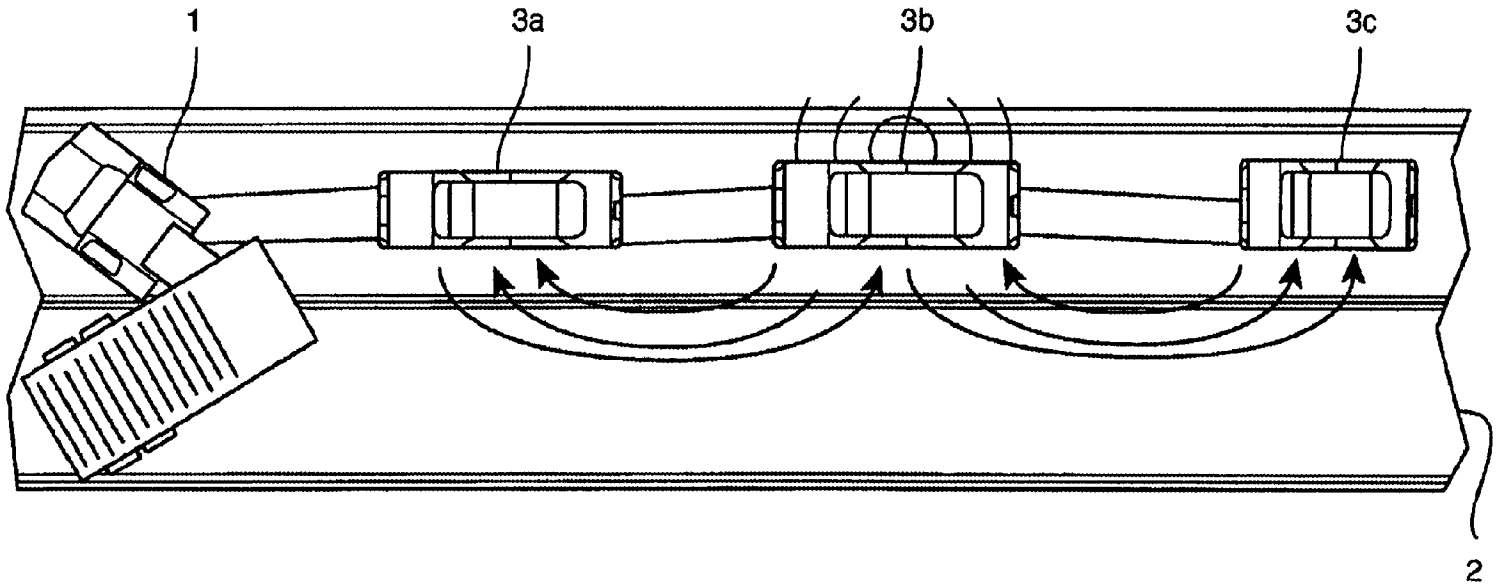
FIG. 1 is a schematic example showing inter vehicle sequential communication.

FIG. 1 shows the advantages of an inter vehicle sequential communication system. In FIG. 1, a truck and tractor rig 1 is shown as blocking a two lane highway 2. Three vehicles are depicted approaching the truck and tractor rig 1. The first vehicle 3*a* is shown closer to the truck and tractor rig 1 than are vehicles 3*b* or 3*c*. It is assumed, for the purpose of this discussion, that the headlights and taillights of the various vehicles are turned on. Indeed, since daytime running lights are now standard on many vehicles, it may become very common for all vehicles to have their headlights and taillights energized during normal day time use as opposed to only at night time. Information transfer can also occur when brake lights are energized when vehicle brakes are applied. In any event, according to the preferred embodiment of the present invention, communication links between the vehicles are preferably established by using the headlights and taillights as communication sources. Low cost sensors 235, 245 (see FIG. 2) installed on the fronts and rears of the vehicles provide light sensitive communication receiving devices for receiving communications from adjacent vehicles.

Returning to the example shown in FIG. 1, it is assumed that automobile 3*a* will communicate the fact that it has slowed considerably or even come to a stop by encoded data transmitted via its taillights to automobile 3*b*. This communication is above and beyond the normal data communication which occurs strictly by the brake lights coming on or the tail lights increasing in brightness to warn other drivers visually that the driver of the automobile in vehicle 3*a* has applied the brakes. The data communication from automobile 3*a* to automobile 3*b* is not dependent upon the driver of vehicle 3*a* having applied the brakes, but rather vehicle 3*a* continuously or periodically supplies data to a trailing vehicle (here vehicle 3*b*) of its current speed, rate of acceleration/deceleration, and the like. Vehicle 3*b* upon receipt of this information preferably passes this information along to vehicle 3*c* along with information about its own current speed, rate of acceleration/deceleration, and the like. Thus vehicle 3*c* receives information not only regarding the velocity and acceleration/deceleration of vehicle 3*b*, but also information concerning the present status (speed, acceleration/deceleration, etc.) of vehicle 3*a*. At the same time, if it appears that an emergency situation is arising, an alarm will preferably sound in vehicle 3*b* if the driver does not appropriately react to the situation, which in this case, if the driver in vehicle 3*b* were approaching vehicle 3*a* too rapidly to apply the brakes. Of course, if an alarm is going off in vehicle 3*b* alerting the driver to apply the brakes, then vehicle 3*b* can pass that information onto vehicle 3*c* in addition to the information noted above.

Figure 2:
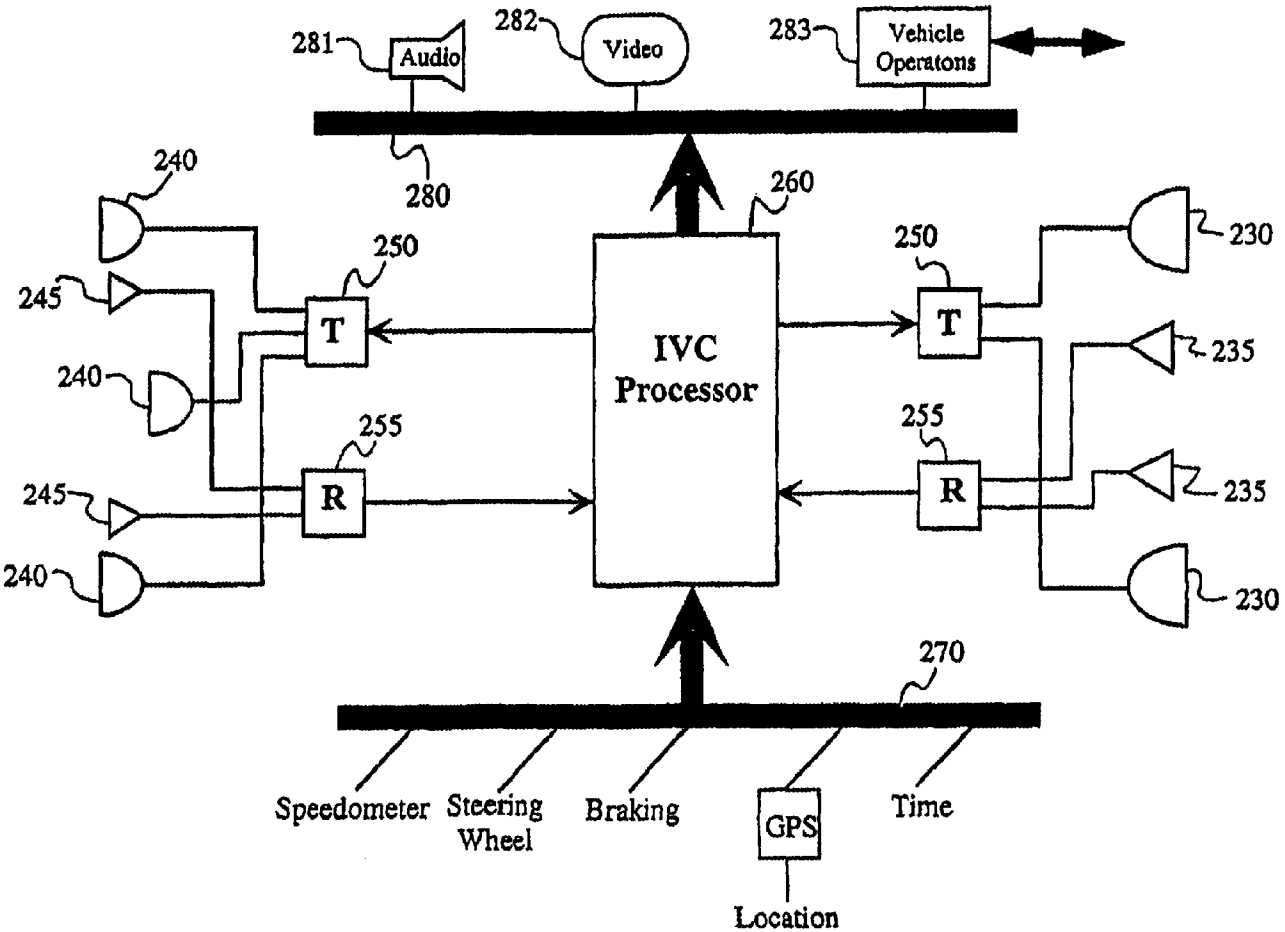
FIG. 2 show a block diagram of an embodiment of the present invention and its interaction with existing automotive components.

A simplified schematic of an embodiment of the present invention is shown in FIG. 2. Referring to FIG. 2, a sensor system at the front of the vehicle is implemented by vehicle headlights 230 and light receptive sensors 235, such as photo-diodes. The vehicle headlights 230 are coupled to a forward transmitter 250 which modulates vehicle and other information onto the light emitted by the headlights 230. The light receptive sensors 235 are coupled to a forward receiver which extracts received data from incident light. Similarly, a sensor system at the rear of the vehicle is implemented by vehicle taillights 240 and light receptive sensors 245. The vehicle taillights are coupled to a rear transmitter 250 and the light receptive sensors are coupled to a rear receiver 255.

A central processor 260 manages the transfer of data to and from the transmitters and receivers. The central processor collects and processes data from a local vehicle sensor bus 270 for transmission either in a forward or rearward direction. Preferably, such a sensor bus would be interconnected with sensor busses used for other vehicle operations. Vehicle sensors connected to the sensor bus may include a speedometer, steering wheel transducer, accelerometers, braking sensor, turn signal indicators, and time and location indicators, among others. The central processor will also combine local collected sensor data with received data to calculate control information to provide to controls within the vehicle. This control information may be sent over a local control bus 280 which is dedicated for use by the communication system or is shared with other vehicle operations. Possible controls to be connected to the control bus include auditory alarms 281, visual indicators 282, and controls over vehicle operation 283, such as automatic cruise control, collision avoidance, etc.

In order to pass information between vehicles, one approach is to use electrical modulators to modulate the current or voltage applied to headlights and taillights. In this manner, vehicles in relatively close proximity will be able to communicate with adjacent vehicles. Inexpensive onboard detectors can be used to sense either the return signal from the vehicle which originated the modulated light or the modulated light from other vehicles. There are several different light sources that can be modulated including Neon, LED, Xenon and incandescent type of lamps. The depth of modulation does not have to be 100% and the bandwidth does not have to be greater than tens of kilohertz in order to pass a sufficient amount of information.

Modulation of headlights or taillights may also be accomplished by covering the lights with a material comprising liquid crystal. The state of the liquid crystal material can be electrically controlled to either pass light through the material or to scatter light within the material. When the light is operating with no applied modulation, the state of the liquid crystal material will be set to pass all light output by the light source. When light modulation is required, the state of the liquid crystal material will be electrically controlled to scatter the light output by the light source according to the information to be transferred. At high data rates and low depth of modulation, the light from the light source will not have a noticeable flicker and the light will not be appreciably dimmed.

For communication between the taillights of the vehicle in front to the vehicle following, a filter before the detector could be used to select the spectral band typically used for taillights, i.e., red light. The detector would allow the system to discriminate between on-coming headlights and taillight emission. The system could also be used to alert the driver of "cross traffic." The system could even be used for communication between vehicles of different types, e.g. cars and trains. Data may also be tagged to indicate its transmission source, i.e., a headlight or taillight.

Information transfer may also be accomplished by modulating a reflected beam, rather than the transmitted beam. This would allow information from a first vehicle to be encoded onto a light beam radiated from a second vehicle and reflected back to that second vehicle, without requiring a separate modulated light source on the first vehicle. To accomplish this, the first vehicle contains retro-reflectors that reflect the light beam or beams back to the second vehicle or to other vehicles. An active retro-reflector can be used to modulate the reflected beam so as to encode the first vehicle information onto the reflected light. The active retro-reflectors can be covered with liquid crystal material as discussed above to either pass or scatter the reflected light to provide the desired modulation. Other means for modulating reflected beams are well known in the art, such as active retro-reflectors comprising one or more mirrors, one or more of which is driven by a piezoelectric transducer. The piezoelectric transducer can be used to control the reflection of a light beam incident on the retro-reflector and can thus provide modulation of the reflected light. Active retro-reflectors may be incorporated into license plate frames, grill work, or any other place on a vehicle that does not interfere with the aesthetics of the vehicle, but still provides the capability to reflect light transmitted by another vehicle.

Algorithms may be developed and used in conjunction with feedback control to perform many functions. The simplest implementation might be if two vehicles are "too" close to each other then the first vehicle could "flicker" its brake lights to warn the second vehicle which is deemed too close. A more sophisticated warning than the alarm noted above might be provided by a "heads up" display of graphics or an audio alarm for either or both drivers. The system could also cause one or both vehicles to reduce their speed by feed back control that would reduce the engine RPM and/or apply the brakes or linking into an automatic vehicle cruise control. The algorithms could use information from various sensors to determine the appropriate action. For example if the measured speed was lower thana predetermined threshold value this might indicate that the vehicle was in very heavy traffic or about to park and therefore the warning message could be modified or disabled.

The system could also be used to transmit information down a string of vehicles traveling on the highway. If an accident or road conditions were approached by a vehicle at the front of the group of vehicles, the road or travel conditions could be broadcast to all of the following vehicles. The information could be relayed to the next one or two vehicles and then sequentially to the next vehicles until all vehicles were aware of the upcoming conditions. Information could be actively relayed by a vehicle capturing the information passed from a leading vehicle, processing that information, and passing that information along with its own vehicle information in a message sent to trailing vehicles. Processing requirements can be reduced by passively relaying information about a leading vehicle with optical devices, such as light guides, which would transmit the emissions from leading vehicles to following vehicles without requiring any processing by an intervening vehicle. Passive or active relaying would allow communications to be established among a small number of vehicles without requiring complete control of communications from an active global communication manager.

The system could use information simultaneously emitted from both head lights to determine the distance between nearby vehicles. Modulation of the emitted light from the headlights would allow forward lights sensors to detect and distinguish reflections of this light from a leading vehicle. Using trigonometric identities, an algorithm based on triangulation in conjunction with the known distance between the two head lights and the angles at which the light is received could be used to determine distances. Alternatively, the time of flight for a message to be transmitted and reflected back from another vehicle could be used to determine distances. The message may simply consist of an optical pulse that is transmitted from a first vehicle to a second vehicle. The second vehicle reflects the pulse back to the first vehicle, which calculates the time required for the pulse to travel from the first vehicle to the second and back to determine the distance between the vehicles. More sophisticated sensors could detect a change in the frequency of the optical pulse for use in calculating the closing rate between vehicles using pulse Doppler techniques well known in the art.

One of the advantages of the system is that it communicates information between vehicles without the driver being a necessary part of the communication link. Moreover, since tail lights and head lights are used as opposed to a radio link, for example, that inherently limits the number of data sources that any particular vehicle must respond to. For example, in terms of the depiction of FIG. 1, since light is being used to communicate information, it is rather unlikely that a sensor on the front of vehicle 3c would "see" the tail lights of vehicle 3*a* because of the intervening presence of vehicle 3*b*. Thus, the communication system in vehicle 3*c* only needs to contend with information from vehicle 3*b*. Of course, as previously noted, vehicle 3*b* can pass information regarding vehicle 3*a* onto vehicle 3*c* and/or pass along information regarding an emergency situation arising in vehicle 3*b* due to the actions taken by the driver in vehicle 3*a*.

However, the system does support transfer of data to multiple vehicles either simultaneously or individually. For example, the head lights on a trailing vehicle will likely illuminate a leading vehicle directly in front of the trailing vehicle, any vehicles positioned adjacent to the leading vehicle, and oncoming vehicles in the opposite lanes. The trailing vehicle can provide messages to all these vehicles simultaneously, or can establish individual message. transfer via a handshaking mechanism. Light sources may be positioned such that transmission of data to multiple vehicles is especially facilitated. For example, the light from emergency beacons ("flashing lights") on an emergency vehicle can be modulated so that all vehicles within visible range will receive messages from that vehicle.

The information passed from one vehicle to another may be weighted as it is passed along to more and more vehicles, with the weight assigned to the information decreasing as the information is passed from vehicle to vehicle. Since geographical positioning systems (GPS) are increasingly being deployed in vehicles, all vehicles will likely have a very accurate clock associated with the GPS system for time stamping the data. The information weight can then be adjusted according to the time at which the data was generated. Algorithms used for processing the data will ensure that the data should only have a "life time" in terms in a number of hops that it can take from one vehicle to another vehicle and/or in terms of the timeliness of the data. These algorithms will thus use the information weight associated with the data to determine what type of notifications are to made to the vehicle operator or actions to be taken.

In addition to passing along vehicle speed and acceleration/deceleration information, critical information such as brake pressure, distance, yaw rate, steering wheel position and lateral acceleration can also be transmitted to other vehicles. Moreover, since GPS systems providing highly accurate location information are also being increasingly deployed in vehicles, then this location information could also be passed along to other vehicles. The number of vehicles to which such data is passed can be controlled by time stamping the data, by controlling the number of hops that the data takes and/or restricting the data based upon distance of the receiving vehicle from the originating vehicle.

Since modern micro processors can process extremely large amounts of data and be very inexpensive compared to the price of an automobile (or even to the price of automobile insurance), the amount of data that a modern microprocessor chip can process very well may be higher than the amount of data that a driver can process. Thus, the inter vehicle communication system, in cooperation with the appropriate onboard computers on the vehicles 3, provides for increased coordination and cooperation between individual vehicles, leading to fewer accidents and of course fewer fatalities on the highway.

Figure 3:
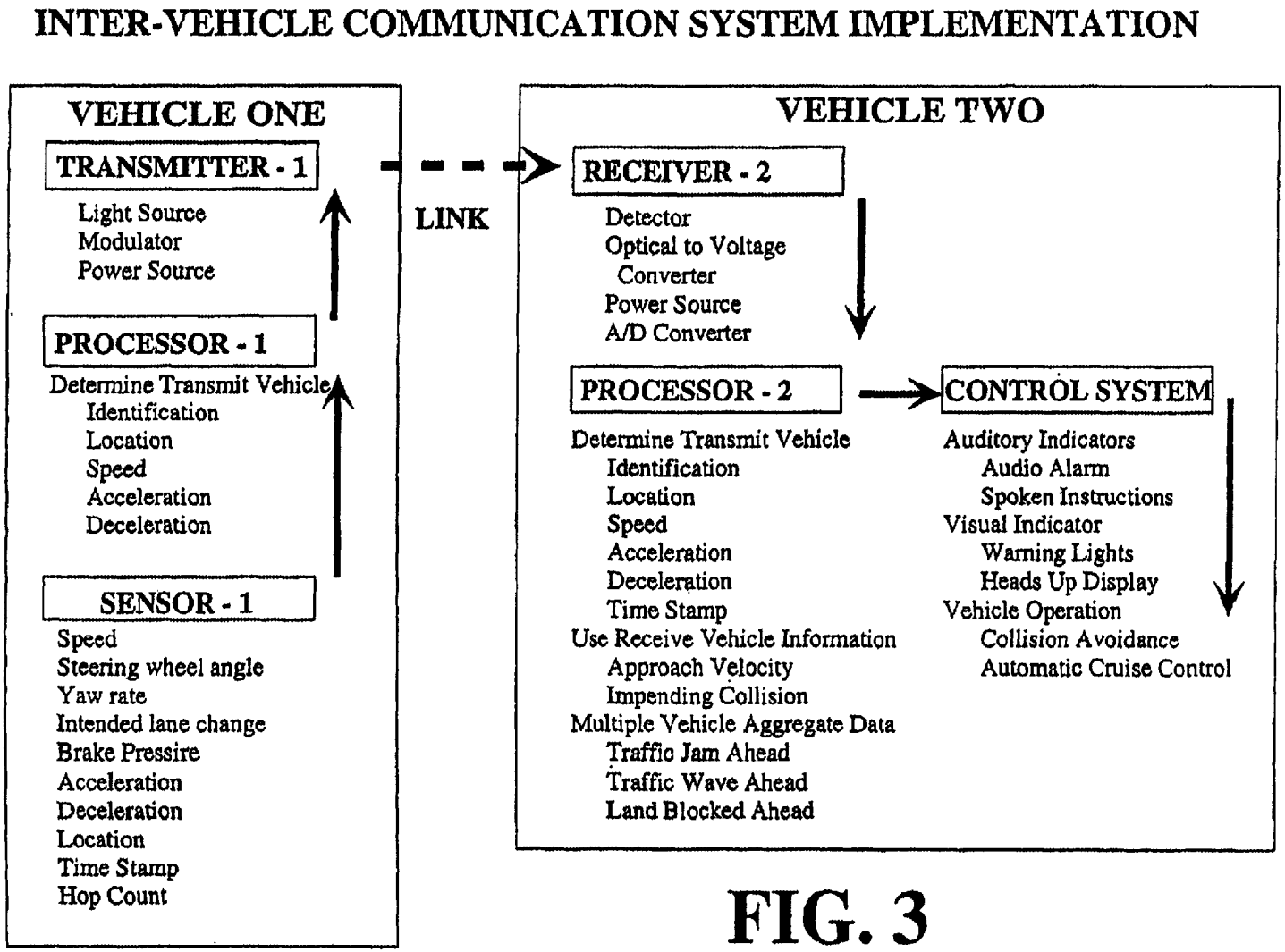
FIG. 3 depicts the information acquisition, transfer, and processing of the present invention.

FIG. 3 illustrates a typical processing sequence. Sensors within a lead vehicle would collect vehicle information such as vehicle speed, steering wheel angle, yaw rate, intended land change (use of turn signal), brake pressure, acceleration or deceleration, vehicle location, and the time at which the information was collected (time stamp). Note that many of these sensors are already present on most vehicles to support other vehicle operations. Location and time information can be provided by low cost GPS receivers. An onboard computer processes the collected information to create a message that describes the present state of the vehicle. To conserve bandwidth, the message may only contain changes from a previous state. If active relaying is used, the message created by the processor may include information received from other vehicles. The message information is then passed to a forward transmitter, a rear transmitter, or both for transmission to other vehicles. The message can be scheduled to be sent upon a change in state of the vehicle, or on a periodic basis.

As shown in FIG. 3, received transmissions are demodulated and converted into a digital form for processing and stored for access. An onboard computer processes the received data to determine the vehicle that provided the data (source vehicle) and the current state of that vehicle. If a data handshake is to be established, the onboard receiver will create a message to be sent back to the source of the data. Based on the received data and data collected from local sensors, the onboard processor will perform calculations to determine the relative states of the source vehicle and the receive vehicle. One such calculation, for example, would be the rate at which the receive vehicle and source vehicle are closing. Source vehicle location and time information will allow the onboard processor to determine if a collision is imminent. The onboard processor will also determine the weight of the information to determine the applicability of the information to the current calculations. The central processor transfers the processed results to onboard controls. These controls provide the vehicle operator with audio or visual cues or provide information to other control systems that actually control vehicle operation. For example, the determination of an imminent collision may cause the vehicle control system to apply braking or to change lanes.

The onboard processor in the receive vehicle also processes the received data to determine data received from other vehicles. This data may have been received by passive relaying or active relaying as described above. Identification and processing of data from multiple sources allows the onboard processor to make situational assessments such as the presence of a traffic jam, traffic congestion, or a lane blockage. Again, the information weights may be determined to ascertain the applicability of the information to the current calculations. If the onboard processor determines that the situation exists in a location ahead of the receive vehicle, audio or visual cues can be sent to the vehicle operator that indicate such situations for the operator to take appropriate action. If the onboard processor determines that the receive vehicle is currently present in a situation, the onboard processor can place that information in a message to be sent to other vehicles. Situational analysis determinations can also be made by comparing the current received data to earlier received data or to earlier results of processing. Finally, the onboard processor may assign priorities to information based upon its calculations, so that higher priority information is transferred sooner or more often to other vehicles. These priorities may also be used to increase the weight assigned to certain information.

The onboard processor on the receive vehicle also supports the recognition and processing of "emergency" signals. Such signals may be obtained from radio frequency wireless links located within emergency vehicles, highway signs, vehicles having problems that broadcast a generalized emergency signal. Emergency signals may be generated by emergency vehicles and transmitted by their rotating beacons as they move through traffic. Emergency signals may also be created by the onboard processor via an input from the vehicle operator or a separate determination that an emergency condition exists. A received emergency signal would trigger an alert to the vehicle operator. The onboard processor could also pass a received emergency signal to other vehicles by including that information in a transmitted message. For example, an emergency vehicle approaching a long chain of cars would transmit an emergency signal to the last car in the chain. That car could forward the message to cars ahead through messages modulated onto its headlights. The other cars could similarly forward the message. The message would also be transmitted to vehicles in opposite lanes via headlight transmissions. Thus all cars in the vicinity of the emergency vehicle would receive information about the presence of the emergency vehicle and take appropriate actions, such as clearing the right-of-way for the vehicle.

As indicated previously, the processor will also make determinations as to the informational weight to be assigned to data obtained from other vehicles. The informational weights may be derived from spatial displacement, temporal displacement, and other factors. Data with a low informational weight may not be used for situational analysis or for operator notification. The processor will also determine if the data is of such a low weight as to not include that data in messages passed to other vehicles. Therefore, data passed from one vehicle to the next will be tagged with a hop count or some other indication to indicate the age of the data and the vehicle source in relationship to the current vehicle. Different data may also have different weights assigned due to the importance of the data, resulting in the information being used by more or less vehicles. For example, an emergency signal may be propagated through a long chain of cars so that the operators of cars at the end of the chain may elect to use alternate routes, while information that a particular car is slowing down may only be propagated to a few trailing cars since only those cars would have any use for that data. Elimination of low weight data from the messages passed to other vehicles also reduces the amount of data that must be relayed to other vehicles.

Other embodiments of the present invention may store both the received messages and the transmitted messages in a long term data storage unit. The messages stored in this unit could be recovered after an accident or other vehicle mishap to assist in the determination of the circumstances of the mishap, much like the examination of "black box" data after the crash of an airplane. The long term data storage unit could also be used to capture control information provided to the vehicle or vehicle operator by the central processor and vehicle sensor information processed by the central processor.

While the system provided by the present invention preferably uses headlights and taillights for the transmission sources, auxiliary lights, LEDs, lasers or other light emitting devices could be used instead. The present invention does not require transmission of light in the visible spectrum. Therefore, light sources and sensors that operate in the ultraviolet or infrared spectrum may also be used in the system provided by the present invention. In some instances, directional or partially directional light sources and sensors are preferred, so as to limit and direct the information transfer between vehicles. In other instances, omnidirectional lights sources and sensors are preferred, so as to ensure information transfer and receipt by a large number of vehicles. In terms of FIG. 1, directional light sources and sensors allow vehicle 3*b* to control the information transfer between vehicles 3*a* and 3*c*, while still allowing some measure of transmission to oncoming vehicles and to vehicles disposed at an angle to a lead vehicle.

Having described the invention in connection with a preferred embodiment thereof, modification will now doubtlessly suggest itself to those skilled in the art. For example, the present invention is not limited to passenger automobiles, but can be used for all traffic on public highways such as trucks, busses, etc. The present invention can also be used for moving vehicles such as trains, airplanes, boats in any situation that involves the path of one vehicle interacting with the path of another vehicle or a stationary object. As such, the present invention is not to be limited to the disclosed embodiment except as required by the appended claims.

What is claimed is:

1. An inter vehicle communication system for communicating between a plurality of vehicles including in each vehicle of said plurality an apparatus comprising:

a central processing unit;

one or more data sources coupled to said central processing unit;

one or more data sensors coupled to said central processing unit; and one or more vehicle sensors coupled to said central processing unit, wherein said central processing unit processes data received from said one or more data sensors and from said one or more vehicle sensors, calculates information weights for said data, generates a transmit message based on said data and said information weights, and provides said transmit message to said one or more data sources.

2. The inter vehicle communication system of claim 1 wherein said apparatus further comprises;

one or more controls, said controls coupled to said central processing unit, wherein said central processing unit calculates control information to be sent to said controls.

3. The inter vehicle communication system of claim 2, wherein each vehicle has a human operator and said controls provide control over operation of at least one vehicle without any human operator intervention.

4. The inter vehicle communication system of claim 1 wherein said apparatus further comprises:

a long term storage unit coupled to said central processor.

5. The inter vehicle communication system of claim 1 wherein the one or more data sources comprise optical sources and the one or more data sensors comprise optical sensors.

6. The inter vehicle communication system of claim 5 wherein the optical sources comprise modulated headlights, taillights, side lights, and some combination thereof.

7. The inter vehicle communication system of claim 6, wherein said optical sources are modulated at a frequency to produce a flicker that is undetectable by a human observer.

8. The inter vehicle communication system of claim 5 wherein the one or more optical sources comprises active retro-reflectors.

9. The inter vehicle communication system of claim 8 wherein the active retro reflectors operate in the infrared spectrum.

10. The inter vehicle communication system of claim 1 wherein said information weights are derived from spatial displacement or temporal displacement of said data.

11. The inter vehicle communication system of claim 1 wherein said data has a specified importance and said information weights are based on said importance.

12. The inter vehicle communication system of claim 1 wherein said transmit message contains a hop count that indicates an age of said data.

13. The inter vehicle communication system of claim 1, wherein said central processing unit processes said data received from said one or more data sensors and from said one or more vehicle sensors to determine changes in said data from a previous state to a current state, generates a changed state transmit message containing only said data which has changed from the previous state to the current state, and provides said changed state transmit message to said one or more data sources.

14. A method of inter vehicle communication comprising the steps of:

sensing vehicle information;

creating a transmit vehicle message from the vehicle information;

transmitting the transmit vehicle message;

receiving the transmit vehicle message at a receive vehicle;

sensing receive vehicle information;

extracting vehicle information from the transmit vehicle message;

weighting the vehicle information to create weighted vehicle information;

processing the receive vehicle information and the weighted vehicle information to determine inter vehicle status; and, providing control information to receive vehicle control system based on the inter vehicle status.

15. The method of claim 14 further comprising the steps of:

creating an acknowledgement message on the receive vehicle;

transmitting the acknowledgement message from the receive vehicle;

receiving the acknowledgement message at the transmit vehicle; and processing the acknowledgement message.

16. The method of claim 14 wherein the step of sensing vehicle information comprises:

receiving other vehicle information from other vehicles; and reading transmit vehicle status from transmit vehicle sensors.

17. The method of claim 14 wherein three or more vehicles are oriented in a chain of vehicles and the steps of claim 14 are repeated for each vehicle in the chain.

18. The method of claim 14 further comprising the step of:

controlling the operation of the receive vehicle based on the inter vehicle status.

19. The method of claim 18, wherein the receive vehicle has a human operator and the step of controlling the operation of the receive vehicle is performed without any human operator intervention.

20. The method of claim 14 further comprising the step of:

alerting the vehicle operator with audio or visual cues based on the inter vehicle status.

21. The method of claim 14 wherein the transmit vehicle and the receive vehicle are traveling in the same direction.

22. The method of claim 14 wherein the transmit vehicle and the receive vehicle are traveling in opposite directions.

23. The method of claim 14 wherein the transmit vehicle message includes an emergency signal and the step of providing control information comprises providing an emergency alert signal to a vehicle operator.

24. The method of claim 14 wherein the step of transmitting the transmit vehicle message comprises transmitting the transmit vehicle message with optical data sources and the step of receiving the transmit vehicle message at a receive vehicle comprises receiving the transmit vehicle message with optical data sensors.

25. The method of claim 24 wherein the optical data sources comprise modulated headlights, taillights, side lights, and some combination thereof.

26. The method of claim 25, wherein said optical data sources are modulated at a frequency to produce a flicker that is undetectable by a human observer.

27. The method of claim 24 wherein the optical data sources comprise active retro-reflectors.

28. The method of claim 27 wherein the active retro-reflectors operate in the infrared spectrum.

29. The method of claim 14 wherein said step of weighting the vehicle information comprises calculating weights for the vehicle information based on spatial displacement or temporal displacement of the vehicle information to create the weighted vehicle information.

30. The method of claim 14 wherein said step of weighting the vehicle information comprises calculating weights for the vehicle information based an importance for the vehicle information to create the weighted vehicle information.

31. The method of claim 14 wherein said transmit vehicle message contains a hop count that indicates an age of said transmit vehicle message.

32. The method of claim 14, wherein said step of creating a transmit vehicle message comprises:

detecting changes in the vehicle information from a previous state to a current state; and creating the transmit vehicle message to contain only the vehicle information which has changed from the previous state to the current state.

33. The system according to claim 1, wherein said data comprises a plurality of data portions and a separate information weight is calculated for each data portion, and the transmit message is generated based on at least one separate information weight and comprises one or more of the data portions of the plurality of data portions.

34. A method of inter vehicle communication comprising the steps of:

sensing current transmit vehicle information of one or more transmit vehicles;

creating a message for each transmit vehicle of the one or more transmit vehicles, each message containing transmit vehicle information for that transmit vehicle;

transmitting the message for each transmit vehicle from one or more sources on each transmit vehicle;

receiving the message from each transmit vehicle with one or more sensors on a receive vehicle;

extracting current transmit vehicle information from each message;

calculating a weight for the transmit vehicle information from each transmit vehicle to create weighted transmit vehicle information;

reading receive vehicle information from receive vehicle sensors; and processing the weighted transmit vehicle information for each transmit vehicle and receive vehicle information to determine multiple vehicle status.

35. The method or claim 34 further comprising the steps of:

storing the current transmit vehicle information for each transmit vehicle;

recovering previously stored transmit vehicle information;

calculating weights for the previously stored transmit vehicle information to create weighted previously stored transmit vehicle information; and processing the weighted previously stored transmit vehicle information and the multiple vehicle status to provide a situation assessment.

36. The method of claim 35 further comprising the step of:

controlling the receive vehicle operation based on the situation assessment.

37. The method of claim 35 further comprising the step of:

alerting the vehicle operator with audio or visual cues based on the situation assessment.

38. The method of claim 34 further comprising the step of:

controlling the receive vehicle operation based on the multiple vehicle status.

39. The method of claim 38, wherein the receive vehicle has a human operator and the step of controlling the receive vehicle operation is performed without any human operator intervention.

40. The method of claim 34 further comprising the step of:

alerting the vehicle operator with audio or visual cues based on the multiple vehicle status.

41. The method of claim 34 wherein the sources comprise optical data sources and the sensors comprise optical data sensors.

42. The method of claim 41 wherein the optical data sources comprise modulated headlights, taillights, side lights, and some combination thereof.

43. The method of claim 42, wherein said optical data sources are modulated at a frequency to produce a flicker that is undetectable by a human observer.

44. The method of claim 41 wherein the optical data sources comprise active retro-reflectors.

45. The method of claim 44 wherein the active retro-reflectors operate in the infrared spectrum.

46. The method of claim 34 wherein said step of calculating a weight for the transmit vehicle information comprises calculating weights for the transmit vehicle information based on spatial displacement or temporal displacement of the transmit vehicle information to create the weighted transmit vehicle information.

47. The method of claim 34 wherein said step of calculating a weight for the transmit vehicle information comprises calculating weights for the transmit vehicle information based an importance for the transmit vehicle information to create the weighted transmit vehicle information.

48. The method of claim 34 wherein said current transmit vehicle information contains a hop count that indicates an age of the current transmit vehicle information.

49. The method of claim 34, wherein said step of creating a message for each transmit vehicle comprises:

detecting changes in the current transmit vehicle information from a previous state to a current state; and creating the message for each transmit vehicle to contain only the current transmit vehicle information which has changed from the previous state to the current state.

50. An inter vehicle communication system comprising:

one or more neon, xenon, or incandescent light sources located on external portions of a first vehicle;

means for modulating said light radiated from said lights sources with data;

one or more light sensors on a second vehicle, said light sensors detecting said light radiated from said first vehicle to create a detected light signal;

means for demodulating said detected light signal to extract said data; and at least one active retro-reflector receiving a light beam from the second vehicle and radiating a modulated reflected light beam.

51. The system according to claim 50 wherein said lights sources comprise vehicle headlights, vehicle taillights, vehicle side lights, vehicle emergency beacons and some combination thereof.

52. The inter vehicle communication system of claim 51 wherein said means for modulating comprises at least one electrical modulator controlling current or voltage applied to the vehicle headlights, the vehicle taillights, or some combination thereof.

53. The inter vehicle communication system of claim 50 wherein said means for modulating comprises electrically controlled liquid crystal material covering at least one of the one or more light sources.

54. The system of claim 50, wherein said light sources are modulated at a frequency to produce a flicker that is undetectable by a human observer.

55. An inter vehicle communication system comprising:

one or more light sources on a first vehicle, said light sources radiating modulated light in a spectrum visible to the human eye;

an electrical modulator coupled to each one of said light sources, said electrical modulator modulating a data signal onto the modulated light radiated from each one of said light sources;

one or more light detectors on a second vehicle, said light detectors sensing said light radiated from said first vehicle to create an electrical detected light signal; and an electrical demodulator receiving said electrical detected light signal wherein at least one light source comprises an active retro-reflector receiving a light beam from the second vehicle and radiating a modulated reflected light beam.

56. The system according to claim 55 wherein said lights sources comprise vehicle headlights, vehicle taillights, vehicle side lights, vehicle emergency beacons and some combination thereof.

57. The inter vehicle communication system of claim 55, wherein said light sources are modulated at a frequency to produce a flicker that is undetectable by a human observer.

58. A system for two-way communication between vehicles comprising:

one or more light source disposed on a first vehicle directing light towards a second vehicle;

a first vehicle modulator modulating at least one light source of the one or more light sources with a first vehicle data signal;

one or more second vehicle light receptors disposed on the second vehicle to receive the modulated light from the first vehicle;

a second vehicle demodulator coupled to said one or more second vehicle light receptors, wherein the second vehicle demodulator recovers the first vehicle data signal from the received light;

one or more active retro-reflectors disposed on the second vehicle, wherein at least one active retro-reflector of the one or more active retro-reflectors is disposed to reflect the light directed from the first vehicle back towards the first vehicle;

a second vehicle modulator controlling the one or more active retro-reflectors to modulate a second vehicle data signal onto the light reflected back to the first vehicle;

one or more first vehicle light receptors disposed on the first vehicle to receive the light reflected from the one or more active retro-reflectors; and a first vehicle demodulator coupled to the one or more first vehicle light receptors, wherein the first vehicle demodulator recovers the second vehicle data signal from the light reflected from the one or more active retro-reflectors.

59. The system according to claim 58 wherein at least one light source radiates light only in the infra-red spectrum and at least one active retro-reflector modulates light only in the infra-red spectrum.

60. The system according to claim 58 wherein the second vehicle modulator controls the active retro-reflectors produce a light flicker that is undetectable by a human observer.

61. The system according to claim 58 further comprising means for receiving data from a third vehicle and the first vehicle data signal, the second vehicle data signal, or the first vehicle data signal and the second vehicle data signal at least comprises data from the third vehicle.

* * * * *